US006406616B1

(12) United States Patent
Rappas et al.

(10) Patent No.: US 6,406,616 B1
(45) Date of Patent: Jun. 18, 2002

(54) PROCESS FOR REMOVING LOW AMOUNTS OF ORGANIC SULFUR FROM HYDROCARBON FUELS

(75) Inventors: Alkis S. Rappas, Kingwood; Vincent P. Nero; Stephen J. DeCanio, both of Katy, all of TX (US)

(73) Assignee: Unipure Corporation, Houston, TX (US)

( * ) Notice: Subject to any disclaimer, the term of this patent is extended or adjusted under 35 U.S.C. 154(b) by 0 days.

(21) Appl. No.: 09/952,850

(22) Filed: Sep. 12, 2001

Related U.S. Application Data

(63) Continuation-in-part of application No. 09/654,016, filed on Sep. 1, 2000.

(51) Int. Cl.[7] ..... C10G 29/22

(52) U.S. Cl. ..... 208/240; 208/237; 208/238; 208/219; 208/223; 208/222; 208/196

(58) Field of Search ..... 208/237, 238, 208/240, 219, 223, 222, 196

(56) References Cited

U.S. PATENT DOCUMENTS 3,761,534 A * 9/1973 Sun et al. ..... 260/674 A
3,816,301 A * 6/1974 Sorgenti ..... 208/208 R
5,310,479 A * 5/1994 Audeh ..... 208/219
5,573,672 A * 11/1996 Rappas et al. ..... 210/638
5,753,102 A * 5/1998 Funakoshi et al. ..... 208/208 R
5,958,224 A 9/1999 Ho et al. ..... 208/240
5,985,137 A * 11/1999 Ohsol et al. ..... 208/263
6,160,193 A 12/2000 Gore ..... 585/833
6,171,478 B1 1/2001 Cabrera et al. ..... 208/212

FOREIGN PATENT DOCUMENTS

EP 0565324 A1 5/1993 ..... C10G/53/14
EP 0 565 324 A1 * 10/1993

OTHER PUBLICATIONS

"Oxidative desulphurisation of oils via hydrogen peroxide and heteropolyanion catalysis" by Frances M. Collins, Andrew, R. Lucy, Christopher Sharp 1997—No Month.
"Desulfurization By Selective Oxidation And Extraction Of Sulfur–Containing Compounds To Economically Achieve Ultra–Low Proposed Diesel Fuel Sulfur Requirements" by Doug Chapados, et al. Mar. 2000.

* cited by examiner

*Primary Examiner*—Nadine Preisch
(74) *Attorney, Agent, or Firm*—Jenkens & Gilchrist

(57) ABSTRACT

A process for desulfurizing hydrocarbons such as gasoline and similar petroleum products to reduce the sulfur content to a range of from about 2 to 15 ppm sulfur without affecting the octane rating is described. The sulfur containing hydrocarbon is contacted at slightly elevated temperatures with an oxidizing/extracting solution of formic acid, a small amount of hydrogen peroxide, and no more than about 25 wt % water.

18 Claims, 2 Drawing Sheets

PROCESS FOR REMOVING LOW AMOUNTS OF ORGANIC SULFUR FROM HYDROCARBON FUELS

Cross Reference to Related Applications

This application is a continuation-in-part of previously filed U.S. patent application Ser. No. 09/654,016 filed on Sep. 1, 2000.

FEDERALLY SPONSORED RESEARCH STATEMENT

Not applicable.

1. Field of the Invention

This invention relates to a process for the removal of organic sulfur compounds by oxidation from hydrocarbon fuels which have relatively low amounts of sulfur present.

2. Background of the Invention

The presence of sulfur in hydrocarbons has long been a significant problem from the exploration, production, transportation, and refining all the way to the consumption of hydrocarbons as a fuel. As government regulations throughout the world increasingly restrict sulfur levels in fuels, the problem of sulfur reduction is being felt by producers, refiners, transporters and marketers of the full range of fuel products, from gasoline and diesel fuel to jet fuel, kerosene, heating oil and heavier fuels. In Western Europe, North America, Japan and other industrial nations the sulfur restrictions on gasoline and on-highway diesel fuel are moving to the ultra-low levels of 30, 15 or even 10 ppm. Consequently, producers, refiners and marketers are seeking low-cost technologies for producing ultra-low sulfur products, with maximum use of existing facilities.

Sulfur can be found in almost any stream within a refinery complex. This is due to the sulfur in the crude oil to be processed. The process technology for removing sulfur that is in almost universal use today is hydrotreating, sometimes referred to as hydrodesulfurization. Hydrotreating, as used herein, is a process whose primary purpose is to reduce the sulfur and/or nitrogen content (and not to change the boiling range) of the feed. While there are many variations and improvements, this technology requires high temperature and pressure in a hydrogen environment and employs advanced catalysts. This process successfully removes the majority of the sulfur compounds in hydrocarbons. However, the substituted thiophenes, especially those having steric hindrance of the sulfur, are particularly difficult and require high severity hydrotreaters having pressures well in excess of 500 psi. Achieving ultra-low sulfur levels requires that most of these difficult-to-hydrotreat compounds be removed, which could drive many refiners to install new hydrotreaters or carry out expensive revamps of their existing hydrotreaters. Gasoline fractions will contain mainly thiophenes and some benzothiophenes but generally little or no dibenzothiophenes. Diesel fractions will contain mainly benzothiophenes and dibenzothiophenes.

The prior art is replete with attempts to reduce the sulfur content of hydrocarbon by both reduction and oxidation of organic sulfur present. Much of this prior art relating to oxidation has taught the use of various peroxides in conjunction with a carboxylic acid and, specifically, the preferred species involved in the practice of this invention; i.e., hydrogen peroxide and formic acid. For example, U.S. Pat. No. 5,310,479 teaches the use of formic acid and hydrogen peroxide to oxidize sulfur compounds in crude oil, limiting the application of the technology only to aliphatic sulfur compounds. There was no hint of the removal of aromatic sulfur compounds. This patent discussion is directed to the removal of sulfur from crude oil rich (about 1–4%) in sulfur compounds. The acid to peroxide ratio was indiscriminately broad and failed to recognize the economic disadvantages to using hydrogen peroxide in attempts to remove large amounts of sulfur, while at the same time failing to recognize the importance of controlling the presence of water to the successful operation. Water was used to extract the sulfones from the treated hydrocarbon in a separate wash step. Further, the prior art also fails to recognize the beneficial effect of limiting the peroxide concentration to low values without compromising either the rate or extent of oxidation of the sulfur compounds.

A recent study entitled "Oxidated Desulfurization of Oils by Hydrogen Peroxide and Heteropolyanion Catalyst," Collins, et al., published *Journal of molecular Catalysis A: Chemical*, 117 (1997) 397–403, discusses other studies to oxidatively remove sulfur from fuel oil, but large quantities of hydrogen peroxide were required. However, the experimental work did show that unacceptable amounts of hydrogen peroxide were consumed thus suggesting the cost of oxidative reduction of sulfur in feedstocks for diesel fuel to be impermissibly high.

In European Patent Application Publication No. 0565324A1, a method for recovering organic sulfur compounds from liquid oil is described. While the stated objective of the patent publication is to recover the organic sulfur compounds, the treatment involves using a mixture of a number of oxidants, one of which is disclosed as a mixture of formic acid and peroxide. The distillation products, the organic sulfones, are removed by a number of methods including absorption on alumina or silica adsorbent materials. The treatments described are characterized by use of a low ratio of formic acid to the hydrogen peroxide.

While this and other prior art recognize the reaction kinetics and mechanism of hydrogen peroxide and other peroxides with organic sulfur compounds present in various fuels, none recognize the combination of factors necessary to successfully and economically remove relatively small amounts of sulfur present in fuels such as diesel oil, kerosine, gasoline, and light oils down to residual levels approaching zero. While low amounts of sulfur will be construed to mean in the context of this invention, those amounts which are less than about 1500 parts per million, an example demonstrates effective removal of 7000 ppm of sulfur such that the present invention is applicable to higher levels of sulfur. Of course in some instances, the practice of this invention may be economically and technically applicable to the treatment of fuels having a sulfur content at these elevated levels. It has been found in the practice of this invention that the sulfur content of the fuel which is left unoxidized is less than about 10 ppm of sulfur, often as low as about 2 ppm to about 8 ppm. Oxidation alone does not necessarily ensure total removal of the sulfur to the same low residual sulfur values since some of the oxidized sulfur species do have a non-zero solubility in the fuel, and a partition coefficient that defines their distribution in the oil phase in contact with a substantially immiscible solvent phase, whether it is an organic solvent as in prior art, or the high acid aqueous phase of this invention. In addition to the substantially complete and rapid oxidation of the relatively low amounts of sulfur in the fuel feed, the present invention also teaches the substantially complete removal of the oxidized sulfur to residual levels approaching zero, and the recovery of the oxidized sulfur compounds in a form suitable for their practical further disposition in an environmentally benign way. Removal of sulfur by oxidation adds another dimension in that it is desirable that such removal of sulfur be accomplished, without reducing the octane rating of the gasoline, whether it be motor, racing or aviation gasoline. This object is accomplished by the present invention.

In an article, Desulfurization by Selective Oxidation and Extraction of Sulfur-Containing Compounds to Economically Achieve Ultra-Low Proposed Diesel Fuel Sulfur Requirements (Chapados, et al., NPRA Presentation, Mar. 26–28, 2000) the oxidation step involved the reaction of the sulfur in a model compound using dibenzothiophene with a peroxyacetic acid catalyst made from acetic acid and hydrogen peroxide. The reaction with the peroxyacid was conducted at less than 100° C. at atmospheric pressure and in less than 25 minutes. After extraction, the process resulted in a reduction of the sulfur content in the diesel fuel. Still, the cost was indicated to be high with the hydrogen peroxide being the biggest cost item and consumed in the process due in large part to the lack of recognition of the part excessive water plays in the efficient utilization of low amounts of hydrogen peroxide.

SUMMARY OF THE INVENTION

It has been discovered that fuel products, such as gasoline and diesel fuel, though meeting the present requirements of about 500 ppm maximum sulfur content, can be economically treated to reduce the sulfur content to an amount of from about 5 to about 15 ppm, in some instances even less and not diminish the octane rating of the fuel product. In practicing the process of the present invention the hydrocarbon fuel containing low amounts of organic sulfur compounds, i.e., up to about 1500 ppm, is treated by contacting the sulfur-containing fuel with an oxidizing solution containing hydrogen peroxide, formic acid, and a limit of a maximum of about 25 percent water. The amount of the hydrogen peroxide in the oxidizing solution is greater than about two times the stochiometric amount of peroxide necessary to react with the sulfur in the hydrocarbon fuel. The oxidizing solution used contains hydrogen peroxide at low concentration, the concentration, in its broadest sense, being from about 0.5 wt % to about 4 wt %. The reaction is carried out at a temperature ranging from about 50° C. to about 130° C., a pressure ranging from about 15 psi to about 250 psi, for less than about 15 minutes contact time at optimum conditions. The elevated pressure is to due to the volatility of the feed stream. The total pressure of the reaction will be dependent upon the partial vapor pressures of hydrocarbon, formic acid, hydrogen peroxide, and water at the selected operating temperature, plus additional pressure from any additioal inert gas. The partial vapor pressure contribution from a naphtha at 95° C. will be about 25 psi. The partial vapor pressure contribution of a diesel at 95° C. will be nil. The oxidizing solution of the invention has, not only a low amount of water, but small amounts of hydrogen peroxide with the formic acid being the largest constituent. Some of the oxidation products, usually the corresponding organic sulfones, become soluble in the oxidizing solution and, therefore, may be removed from the oxidized fuel by a subsequent phase separation step. The aqueous phase is removed from the hydrocarbon phase now having a reduced sulfur content. Depending on the solubility of the sulfones, some sulfones may be left in the hydrocarbon phase. Where there is a residual amount of oxidized sulfur compounds, usually sulfones, in the hydrocarbon fuel, this invention enables the practical and economic use of additional separation steps to remove the sulfones from the hydrocarbon fuel. Sulfones may be removed by selected solid adsorbants such as, for example, in a cyclic adsorption-desorption operation to achieve a substantially sulfur-free hydrocarbon fuel product. The adsorption-desorption operation also recovers the oxidized sulfur compounds in a concentrated form, practical for their final, environmentally benign, disposition within a refinery. It is another object of the invention that the fuel goes through this oxidation process while leaving undisturbed the carbon to hydrogen ratio and the olefininc compounds which contribute to the octane rating of the hydrocarbon fuel. Octane rating is the resistance of the hydrocarbon fuel to burn. The higher the rating, the slower the burn when ignited during the compression burn cycle of the piston. Higher octane allows for better control of burning for high compression engines.

Once the extract containing the oxidized sulfur compounds is separated from the desulfurized hydrocarbon fuel, or raffinate, the extract can be treated to recover the acid for recycle. The separation between the hydrocarbon phase and the aqueous phase can be accomplished in a number of ways, but the preferred separation occurs by the use of a liquid-liquid separator operated at a temperature sufficiently high, close to the oxidation reaction temperature, to result in gravity separation of the material without the appearance of a third, precipitated solid phase. The aqueous phase, of course, being heavier than the hydrocarbon phase would be drained from the bottom of the separation device where it may be preferably mixed with a suitable high boiling range refinery stream, such as for example, a light gas oil,and flash distilled to remove the water and acid overhead while transferring and leaving the sulfur-containing compounds in the gasoil stream exiting at the bottom of the distillation column. The overhead stream containing acid and water from the flash distillation tower is further distilled in a separate column to remove a portion of its water for disposal. The acid recovered can then be returned to the oxidizing solution make up tank where it is combined with the hydrogen peroxide to form the oxidizing solution and again contact the sulfur-containing fuel feed. This preservation of the acid enhances the economics of the process of this invention.

After separation, the hydrocarbon fuel may be contacted with a caustic solution, or with anhydrous calcium oxide (i.e., quicklime) and/or passed through filtering devices to neutralize any trace acid remaining and to make a final dehydration of the hydrocarbon fuel. The hydrocarbon fuel may then be passed over a solid alumina bed, at ambient temperature, to adsorb the residual oxidized sulfur compounds soluble in the hydrocarbon fuel, if any are present. The hydrocarbon fuel product is now substantially desulfurized, neutralized, and dry.

The oxidized sulfur compounds adsorbed on alumina may be removed by desorption and solubilization into a suitable hot polar solvent, methanol being the preferred solvent. Other suitable solvents are acetone, THF (tetrahydrofuran), acetonitrile, chlorinated solvents such as methylene chloride as well as the aqueous oxidizer solution with high acid contents of this invention. One advantage of the adsorption/desorption system of this invention is that it can use commericallyavailable alumina adsorbants that are used in multiple cycles without significant loss of activity and without the need to reactivate them by conventionally employed high temperature treatment for dehydration. The extracted oxidized sulfur compounds are transferred into higher boiling refinery streams for further disposition by flash distillation, which also recovers the methanol for recycle in the alumina desorption operation.

The oxidizing solution of the invention is preferably formed by mixing a commercially-available 96 wt %, by weight, formic acid solution with a commercially-available hydrogen peroxide solution normally the 30 wt %, 35 wt % and 50 wt % concentration commercially available in order to avoid the dangers connected with handling a 70 wt % hydrogen peroxide solution in a refinery environment. The solutions are mixed to result in an oxidizing material containing from about 0.5 to about 4 wt % hydrogen peroxide, less than 25 wt % water with the balance being formic acid. The water in the oxidizer/extractor solution normally comes from two sources, the dilution water in the peroxide and acid solutions used, and the water in the recycled formic acid which includes part of the water formed in the oxidation reaction, when the process operates in the recycle mode. On occasion, additional water could be added without being detrimental to the practice of this invention as long as the criteria explained herein are considered, but it is important to an economical process to keep the water content low as set forth herein. The preferable concentration of hydrogen peroxide, which is consumed in the reaction, in the oxidizer solution would be from about 1% to about 3% by weight, and most preferably from 2 to 3 wt %. The water content would be limited to less than about 25 wt %, but preferably between about 8 and about 20%, and most preferably from about 8 to about 14 wt %. The oxidation/extraction solution used in the practice of this invention will contain from about 75 wt % to about 92 wt % of carboxylic acid, preferably formic acid, and preferably 79 wt % to about 89% wt formic acid. The molar ratio of acid, preferably formic acid, to hydrogen peroxide useful in the practice of this invention is at least about 11 to 1 and from about 12 to 1 to about 70 to 1 in the broad sense, preferably from about 20 to 1 to about 60 to 1.

This will accomplish a rapid and complete oxidation of the sulfur compounds, and their substantial extraction from such refined products as diesel fuel, jet fuel, or gasoline, whether motor, racing or aviation gasoline, which contain from about 30 to about 1500 ppm sulfur and will perform effectively to oxidize and extract organic sulfur present in fuels at greater concentrations. Since the moles of hydrogen peroxide to be used is proportional to the amount of sulfur present and since the peroxide is consumed, the cost of this material can have a negative effect on the economics of the operation if the amount of sulfur present is high. Therefore, this invention is properly most useful for polishing small amounts of sulfur, such as for example less than about 1500 ppm, from hydrocarbon fuels ready for market than for removal of sulfur from crude oil containing gross amounts of sulfur.

In the oxidation of organic sulfur compounds using hydrogen peroxide, the stochiometric reaction ratio is two moles of the hydrogen peroxide consumed per mole of sulfur reacted. In the practice of this invention the amount of oxidizing solution used should be such that it contains at least about two times the stochiometric amount to react the sulfur present in the fuel, preferably from about two to about four times. Greater amounts could be used, but only at increased cost since it has been found that improvement of sulfur oxidation is marginal at best when the amount is greater than four times the amount needed. Furthermore, to minimize peroxide losses by decomposition side reactions, the hydrogen peroxide concentrations in the oxidizer composition of this invention are preferably adjusted at low levels about 0.5 wt % to about 4 wt %. At these levels and the reaction temperature of about 95° C. and a pressure of about 15 to about 250 psi, depending upon the hydrocarbon involvedit has been discovered that the rapid and complete oxidation, and extraction, of the sulfur compounds from hydrocarbon feeds of relatively low sulfur content, compete favorably with the side reaction of peroxide decomposition, resulting in a practical and economic process for desulfurization of such fuels.

By limiting the water and hydrogen peroxide present and the reaction conditions of this invention, a practical process results with almost complete oxidation of organic sulfur compounds at high rates, with low peroxide concentrations, at relatively small peroxide excess over the stoichiometric requirement, and on feeds with relatively low sulfur content; all of these conditions being recognized in the art as kinetically unfavorable conditions. In addition to this unexpected result, it is accomplished with little loss of the expensive hydrogen peroxide to expected side reactions of self decomposition, or with other hydrocarbon species.

While the following invention is described in some detail, it must be understood by those skilled in the art that there is no intention on the part of the inventors hereof to abandon any part of the concepts of this invention with respect to the reduction of the organic sulfur in fuels and light oils.

DETAILED DESCRIPTION OF THE INVENTION

Figure 1:
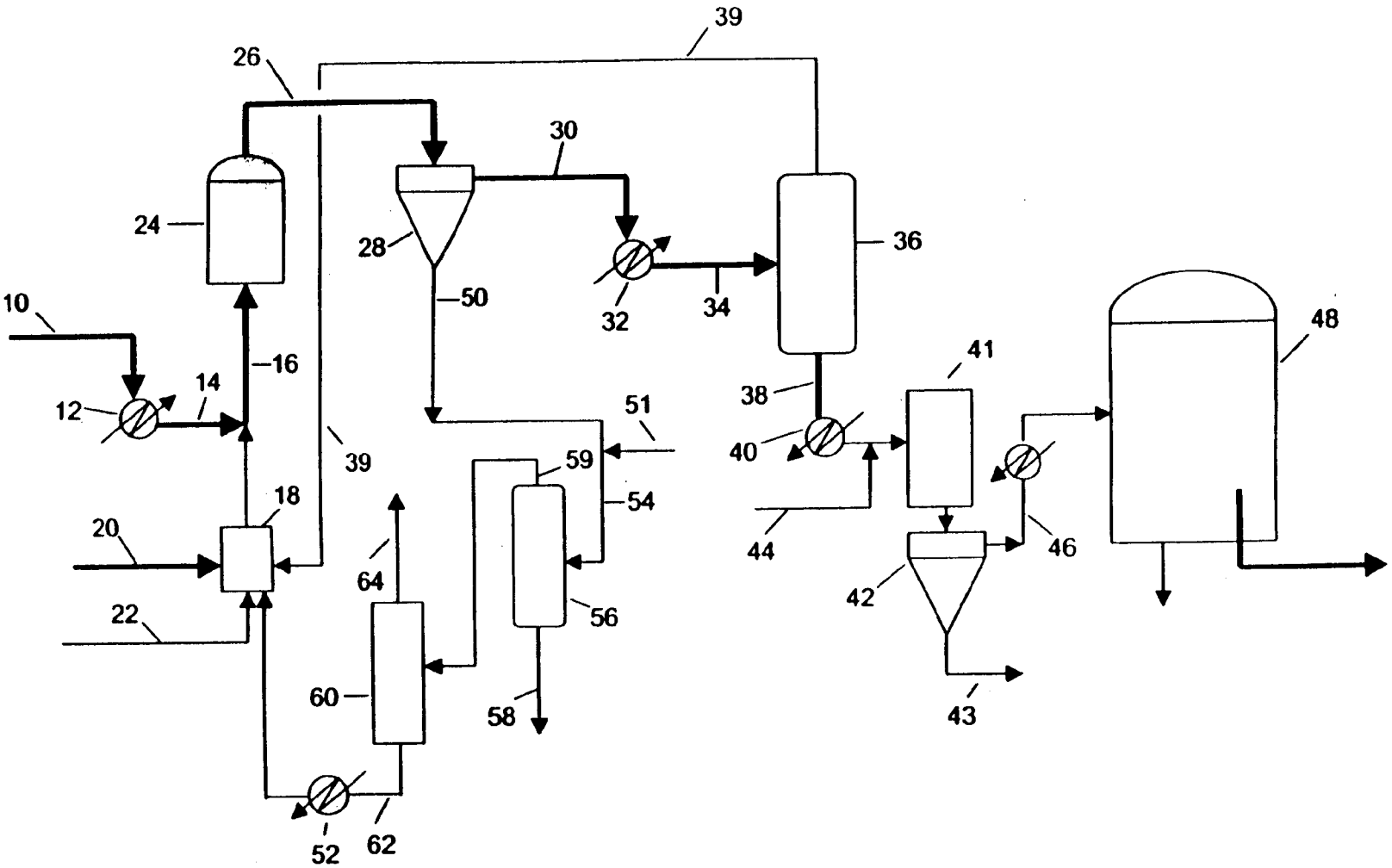
FIG. 1 shows a schematic flow sheet of the preferred process of the instant invention wherein the sulfur removal is accomplished by the oxidation/extraction step alone.

The invention summarized above will be more completely described as set forth hereinafter. The process of this invention surprisingly oxidizes, almost quantitatively, organic sulfur compounds when polishing commercial diesel fuel, gasoline, kerosene, and other light hydrocarbons which have been refined, normally after a hydrogenation step in a hydrotreater where sulfur compounds are reduced and removed leaving a small number of sulfur species which are hydrogenated only with considerable difficulty. The hydrocarbon stream may also be a straight-run fuel from the crude distillation tower, atmospheric or vacuum. Also, the process of this invention has almost no effect on other molecular species present in the hydrocarbon. Because there is little or no oxidation of olefins present, the oxidation reaction does not diminish the octane rating of the hydrocarbon. While the oxidation reaction of organic sulfur compounds with hydrogen peroxide and formic acid itself is well-known, the complete, almost quantitative, oxidation of the sulfur in hydrocarbons containing a small amount of organic sulfur is not known. The oxidation of the hydrocarbons having an amount of organic sulfur, up to about 1500 ppm, preferably from about 200 to about 1000 ppm, occurs by reaction with an oxidizing/extraction solution having a low concentration of hydrogen peroxide, generally from about 0.5 to about 4 wt %, but preferably 0.5 to 3.5 wt %, or about 2% to about 3 wt % in the presence of a small amount of water, less than about 25 wt %, preferably less than about 20 wt %, but preferably in a range from about 8 wt % to about 20 wt %, but most preferably from about 8 wt % to about 14 wt %. The rest of the oxidizing solution is formic acid. The oxidation/extraction solution used in the practice of this invention will contain from about 75 wt % to about 92 wt % of carboxylic acid, preferably formic acid, and preferably 79 wt % to about 89 wt % formic acid. The molar ratio of acid, preferably formic acid, to hydrogen peroxide useful in the practice of this invention is at least about 11:1 and is preferably from about 12:1 to about 70:1 in the broadest sense, preferably from about 20:1 to about 60:1. This oxidizing solution is mixed with the hydrocarbon in an amount such that the stochiometric factor is an excess of two times the amount of hydrogen peroxide needed to react with the sulfur to a sulfone, preferably from about 2 to about 4, that is to say that there is greater than about four moles of hydrogen peroxide for each mole of sulfur in the fuel. The reaction stoichiometry requires 2 moles peroxide for each mole thiophenic sulfur. Thus, a stoichiometric factor (StF) of 2 would require 4 moles peroxide per mole sulfur. Of course, a higher factor can be used, but it gives no practical advantage.

A discovery that the process of this invention does remove organic sulfur so effectively (i.e., at high rates and complete oxidation with low peroxide excess loss) given the low hydrogen peroxide concentration in the oxidizer/extractor solution and fuel feeds with low concentrations of sulfur is seen. Those skilled in the art will appreciate that for proper mixing of two substantially immiscible liquids, the fuel oil and the aqueous oxidizer-extractor solution, the volumetric ratio of oil to water for the two phases should be lower than about 10:1 or, on the outside about 20:1. That means that adequate mixing can be achieved for example by mixing 100 ml fuel with 5–10 ml of an aqueous solution. but it would be extremely inefficient to attempt to mix in 0.5 to 1 ml of an aqueous solution (corresponding to a high concentration peroxide case) with 100 ml of a fuel. If the process required higher peroxide concentrations to work efficiently, as for some prior art processes, this condition for the volumetric ratio would result in very large amounts of peroxide at the end of the oxidation process not being used to oxidize the sulfur and thus available to decompose by side reactions. Such solutions would need to be recycled to increase the peroxide utilization. Before recycle, water would need to be removed to maintain a mass balance, and any further handling of unstable and unpredictable and unsafe peroxide solutions would be impractical. Dealing with such problems would be futile when compared with the practicality and benefits of the process of the present invention. Another discovery of the process is that the carbon to hydrogen ratio and octane rating of the final hydrocarbon fuel product is not affected. This is a particularly important feature when gasoline is the hydrocarbon fuel being treated.

In preparing the oxidizing solution, hydrogen peroxide, which normally is available in aqueous solutions at concentrations of 30 wt %, 35 wt %, 50 wt % and 70 wt %, is mixed with formic acid which also has about 4% resident water present. Formic acid is normally available in a 96 wt % acid grade and, therefore, water is introduced into the system when the reactants are mixed. On occasion there may be an interest in adding additional water to the system. Even though it is of considerable interest in the successful operation of this invention to minimize the amount of water, handling and storing high concentrations of hydrogen peroxide is so great a safety hazard in a refinery that the preferred commercially available concentration would be the 35 or 50% peroxide solution even though Technically, any source of hydrogen peroxide would be satisfactory as long as the ultimate oxidizing solution criteria detailed herein is followed.

Turning now to FIG. 1 for a detailed discussion of preferred embodiments of this invention, it will be understood that this detailed discussion is for points of example only and that it should not be taken to be a dedication or waiver of any other modifications or alterations of the process which remain insubstantially different from that as described here or claimed. Now turning to the process, the sulfur-containing fuel is introduced through line 10. If gasoline fuel is the feed, for example, the current refinery-grade gasoline fuel product has a maximum sulfur content of about 500 ppm, the gasoline specification as listed in ASTM Method D4814, Standard Specification from Automotive Spark-Ignition Engine Fuel. The Environmental Protection Agency (EPA) Tier 2 gasoline ruling reduces the allowable sulfur in gasoline from the current level of 300 ppm to the new level of 30 ppm, effective in 2005 for most refineries. The feed enters through line 10 and, if required, passes through heat exchanger 12, where it is brought to a temperature slightly above the desired reaction temperature. If the feed comes from a storage tank it may need to be heated, but if it comes from another operation in the refinery it may be hot enough to be used as it is or even cooled. In the practice of this invention the oxidation and extraction is carried out at a temperature of from about 50° C. to about 130° C., preferably from about 65° C. to about 110° C., and most preferably from about 90° C. to about 105° C. The feed is heated to a higher temperature so that, after passing through line 14 into line 16, where it is mixed with the oxidizing solution, the resulting reaction mixture will cool down to be within the reaction temperature range. In the practice of this invention the oxidation and extraction is carried out at a pressure of from about 15 psi to about 250 psi, depending upon the hydrocarbon feed. Diesel feeds would be preferably oxidized close to atmospheric conditions. Gasoline feeds would preferably be oxidized around 40 psi. The actual total pressure will be dependent upon the partial vapor pressures of hydrocarbon, formic acid, hydrogen peroxide, and water at the selected operating temperature, plus additional pressure from any additional inert gas. The partial vapor pressure contribution from a naphtha at 95° C. will be about 25 psi. The feed is pressurized due to its volatility. The hydrogen peroxide enters mixing tank 18 through line 20 where it is joined with acid stream 22 to form the oxidizing solution, which is combined in line 16 with the heated feed entering through line 14. Recovered acid may also be added to the mixing tank 18 for reuse.

The feed and the oxidizing stream enter reactor 24 where the oxidation and extraction occurs, usually within about 5 to about 15 minutes contact, to satisfactorily oxidize the organic sulfur and extract the oxidized sulfur compounds from the fuel. These reactions do not affect the octane rating of the gasoline fuel. If the feed contains alkenes, a small percentage of the alkenes, less than 1%, might be converted to alcohols. The reactor design should be such that agitation of the fuel and oxidizing/extracting solution should cause good mixing to occur such as with in-line mixers or stirred reactors, for example, operated in series. It is preferable that the contact residence time be from about 5 to 7 minutes, with no more than about 15 minutes being required for complete conversion with the proper stochiometric factor and concentration within the oxidation solution when polishing a fuel containing low levels of sulfur compounds, such as a commercial gasoline fuel. Greater times may be employed without departing from the scope of this invention, particularly when lower concentrations of formic acid are used. Suitable reactors for this step are a series of continuous stirred reactors (CSTR), preferably a series of 2 or 3 reactors. Other reactors which would provide proper mixing of the oxidizing solution with the hydrocarbon are known to the skilled engineer and may be used.

After the exothermic oxidation reaction occurs, the oxidized sulfur organic compounds become soluble in the oxidizing solution to the extent of their solubility in the hydrocarbon or aqueous solution and, thus, the solution not only causes the oxidation of the sulfur compounds in the hydrocarbon fuel, but serves to extract a substantial part of these oxidized materials from the hydrocarbon phase into the oxidizing solution aqueous phase. The reaction product leaves the oxidation reactor 24 through line 26 as a hot two-phase mixture and proceeds to a settling tank 28 where the phases are allowed to separate with the hydrocarbon fuel phase having lowered sulfur content leaving the separator 28 through line 30. If alcohols were produced by the oxidation of alkenes in the feed to alcohols, the alcohols are soluble in the hydrocarbon phase. The hydrocarbon phase is further heated in heat exchanger 32 and conveyed by line 34 to a flash drum 36 where the fuel is flashed to separate residual acid and water. An azeotropic solution of water and formic acid exits flash drum 36 through line 39 to be recycled and become part of the oxidizing solution's makeup in mixing tank 18. Alternatively, the water and acid may require additional processing (not shown) through a distillation step. It has been discovered that the preferred high acid concentration oxidizer compositions of this invention with low water content also have the added benefit of having a higher extracting capacity for sulfones formed by the oxidation reaction.

The fuel product exits the flash drum 36 through line 38 and, as shown in FIG. 1, is cooled in heat exchanger 40 for subsequent filtering or treatment in holding tank 41 to remove any residual water, acid, or trace sulfur compounds which may remain that are subject to filtration removal. Some caustic or calcium oxide may be added to the fuel through line 44 to enter holding tank 41 to neutralize residual acids in the treated fuel. While any suitable material which would neutralize the acid may be used, use of dry calcium oxide (quicklime) would not only neutralize residual acid, but would al so serve to dehydrate the fuel as can easily be determined by a skilled engineer. The presence of the solid calcium oxide provides facile removal of latent precipitates of residual oxidized sulfur compounds by seeding and filtration. Only a small amount is needed and can be easily determined by the skilled engineer from an analysis of the fuel in the hydrocarbon phase. Use of quicklime is technically preferred to neutralization by washing with caustic solution followed by salt drying. The fuel and solid calcium salts enter post treatment vessel 42 which can be any appropriate solids-liquids separator. From the post-treatment vessel 42, the fuel product exits through line 46 to storage tank 48. While the dehydration and final cleaning of the fuel can be accomplished in many ways known in the art, the foregoing is satisfactory for the practice of this invention. Any solids present exit post treatment vessel 42 through line 43 for appropriate use or disposal. The details of such an operation would be well-known to the process engineer.

The aqueous oxidation/extraction solution now carrying the oxidized sulfur compounds is removed from the separation vessel 28 through line 50, where it is preferably mixed with hot gasoil from stream 51 and conveyed through line 54 through a flash distillation vessel 56 to strip the acid and water from the oxidized sulfur compounds, mostly in the form of sulfones, which are transferred by solubilities or fine dispersion into the hot gasoil and removed from the flash tank 56 through line 58 for ultimate treatment. In a preferred embodiment, the oxidized sulfur compounds and the gasoil may be fed to a hydrotreater, operating under usual refinary conditions, where the sulfur is removed by reacting with hydrogen. The conditions of the hydrotreater are a temperature from about 100° C. to about 400° C.; a pressure of from about 100 psig to about 1,000 psig; a liquid hourly space velocity (LHSV) of from about 02 to about 100; and a gas flow range from about 100 to about 5,000 SCFB (Standard cubic feet per barrel) of gas having at least about 70% hydrogen. The conditions, catalyst and unit operations mentioned here are known to the process engineer. When gasoil is used to strip the sulfones and send them to a hydrotreater, it presents another advantage because the disposal of the sulfones does not create another hazardous waste stream for difficult disposal, but substantially eliminates the sulfur in the hydrocarbon fuel through existing refinery operations. The addition of the gasoil at this point in the process assists in the flash separation of the water and formic acid flash tank 56, while gathering the sulfur-containing compounds with it and the sulfur already in a gasoil for proper treatment within the refinery. The amount of gasoil used, of course, will be dependent upon the amount of sulfur-containing compounds in the process stream. The amount is not critical except that it is desirable that all of the sulfur compounds accompanying the aqueous stream be brought into the gasoil stream either by solution or dispersion therein. Also, since the environment within which the instant process is to be practiced will normally have streams of gasoil at elevated temperatures, the elevated temperature material can be used to enhance the flashing step in flash tank 56. Of course, those skilled in the art will recognize that if the temperature is too high, the aqueous materials could prematurely flash and, therefore, there must be a balancing of temperature and pressure at this point. It is an advantage, however, that such a stream could be used to raise the temperature of the material and thereby enhance the separation in flash tank 56. These are parameters that are familiar to the skilled engineer. Where gasoline is being separated from water, diesel is an appropriate gas oil for use just as a vacuum gas oil is appropriate to use where the sulfur is being removed from diesel and a diesel-water separation is made.

In an alternate embodiment, the aqueous oxidation/extraction solution now carrying the oxidized sulfur compounds is removed from the separation vessel 28 through line 50, where it is preferably mixed with a hot gasoil from stream 51 and conveyed through line 54 through a flash distillation vessel 56 to strip the acid and water from the oxidized sulfur compounds, mostly in the form of sulfones, which are transferred by solubilities or fine dispersion into the hot gasoil and removed from the flash tank 56 through line 58 for ultimate disposal into a coker or the like. The conditions and unit operations mentioned here are known to the process engineer. When a gasoil is used in the practice of this invention as described here it will normally be a refinery stream which is destined for disposal into a hydrotreater, coker or the like. This gives this invention even another advantage because the removal of the sulfur from the fuel does not create another hazardous waste stream for difficult disposal. A gas oil stream is the heavy atmospheric distillation fraction of crude oil and in a refinery operation it is essentially free. It is usually already rich in sulfur and is generally sent to a hydrotreater. The small incremental effect from the sulfones would have no influence on the operation of the hydrotreater. A vacuum gas oil stream is the a vacuum distillation fraction of crude oil and in a refinery operation it is again essentially free. It is usually already very rich in sulfur and is generally sent to a catalytic hydrotreater.

The aqueous oxidation/extraction solution now carrying the oxidized sulfur compounds is removed from the separation vessel 28 through line 50, conveyed through a flash distillation vessel 56 to strip the acid and water from the oxidized sulfur compounds, mostly in the form of sulfones, which are removed from the flash tank 56 through line 58 for ultimate treatment by returning to a hydrotreater where the oxidized sulfur is removed by reacting with hydrogen. In an alternate embodiment, separated sulfones could be also be disposed of in a coker unit.

The overhead stream from the flash distillation tank 56 exits through line 59 and thence into azeotropic column 60, where the water is taken off overhead through line 64, and the recovered formic acid containing slight residual water is recycled through line 62, cooled in exchanger 52, back to the mixing vessel 18 for reuse. In the event the formic acid in line 39 requires additional separation from water, it too can be introduced into distillation column 60 along with the overhead stream in line 59.

Alternate embodiments treating the oxidized sulfur compounds include transferring and incorporating the sulfones into hot asphalt streams. Another embodiment is to distill off most of the acid and water for recycle, leaving at the bottom of the separation vessel 28 a more concentrated sulfone solution which can be chilled to precipitate and recover the solid sulfones by filtration. Other ways of acceptable disposal will be apparent to those skilled in the art.

Figure 2:
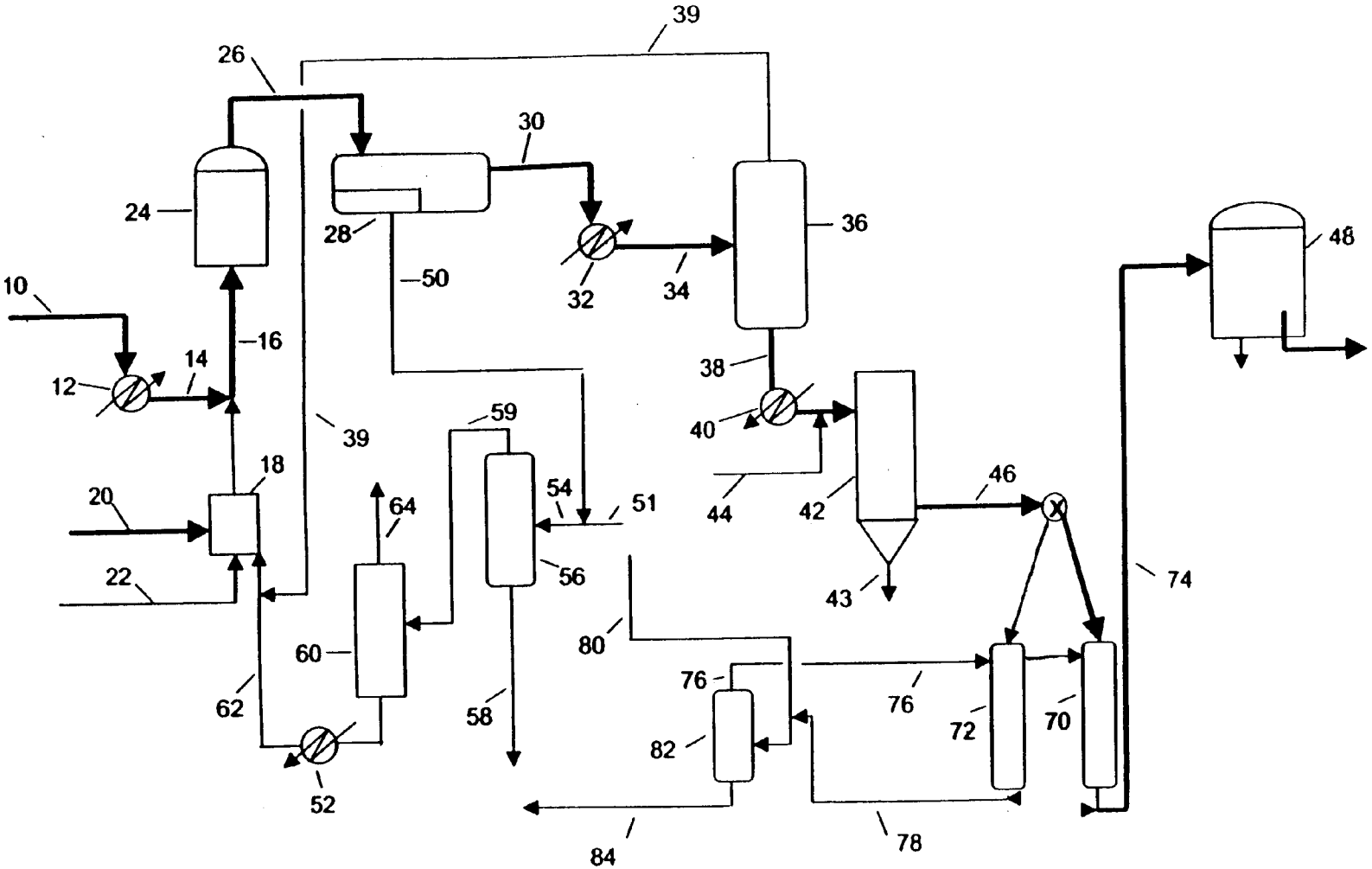
FIG. 2 is an alternative schematic flow sheet showing a preferred processing sequence for the additional removal of sulfur oxidation products which are soluble in the hydrocarbon fuel.

An alternative embodiment is shown on FIG. 2. The parts of equipment and lines shown also in FIG. 1 are numbered as in FIG. 1 for convenience. Here, the fuel is contaminated with thiophenes having other hydrocarbon moieties on the molecule creating a hydrocarbon-soluble sulfone oxidation reaction product. Stream 46 exiting the neutralization-dehydration and filtering vessel 42 may still contain some oxidized sulfur compounds dissolved in the fuel. The presence of a residual oxidized sulfur level in the hydrocarbon indicates that an equilibrium solubility of these compounds exists in both the fuel oil and the aqueous acidic phase. This residual oxidized sulfur compound in the treated fuel can be removed by known liquid-liquid extraction techniques with suitable polar solvents such as, for example, methanol, acetonitrile, dimethylsulfoxide, furans, chlorinated hydrocarbons as well as with additional volumes of the aqueous acidic compositions of this invention. However, the solvent extraction approach for achieving low sulfur limits approaching zero is quite cumbersome, ineffective, impractical and expensive, especially when applied to fuel with such low starting sulfur contents which result from the initial oxidation/extraction step in the practice of this invention.

An effective and practical way to achieve substantially complete removal of the residual oxidized sulfur compounds has been discovered. According to the process of this invention, the neutralized, dryed, and filtered fuel stream 46 is passed, alternatively, through packed or fluidized adsorption columns 70 or 72 over solid alumina (non-activated) having a relatively high surface area (such as that for fine granular material of 20–200 mesh size). Those skilled in the art could select a proper size based upon selected operation conditions and availability. Columns 70 and 72 are used in multiple adsorption-desorption cycles without significant loss of activity, but most importantly without the need to reactivate by high temperature treatment, such as calcination, which is conventionally employed in some industrial practices requiring the use of activated alumina. When sulfur breakthrough into the outlet stream of the column occurs at the selected concentration value in stream 74, stream 46 is diverted to a second column 72 operating in parallel.

Column 70 is now ready for the desorption cycle to remove the adsorbed oxidized sulfur, and regenerate the column for use again in the next adsorption cycle. The breakthrough concentration could be considered to be any sulfur concentration acceptable to the market, for example from 30 to about 40 ppm sulfur. The occurrence of a breakthrough is dependent on the volume of feed and dimension of the column relative to the size of the packing; all within the ability of the engineer skilled in the art.

The adsorption-desorption operations can be carried out in packed bed columns, circulating countercurrent fluidized alumina, mixer-settler combinations, and the like, as known to the skilled engineer. The adsorption cycle can be accomplished at ambient temperature, and at pressures to ensure reasonable flow rates through the packed column. Of course, other conditions may be used as convenient. The desorption cycle in column 70 starts by draining the fuel from the column 70 at the end of the adsorption cycle. When the fuel is something other than gasoline, the column 70 is washed with a lighter hydrocarbon stream such as, for example, a light naphtha, to displace remaining fuel wetting the solid adsorbent surfaces. Usually about one bed volume of naphtha is sufficient for this purpose. Steam or hot gas is passed through the column 70 to drive off the naphtha and to substantially dry the bed. When the feed is gasoline the alumina bed need only to be dried. No washing is necessary. The recovered fuel, drained fuel, naphtha wash, and the naphtha recovered by separating from the stripped step are all recovered.

The actual desorption of the oxidized sulfur compounds from the solid alumina is preferably accomplished by passing hot (50–80° C.) methanol from stream 76 through the packed column under sufficient pressure to ensure proper flow through the bed, while preventing flashing of methanol through the bed. This extraction can be achieved efficiently by either co-current, or counter-current flow relative to the flow used in the adsorption column. Part of the methanol extract can be recycled in the column to provide sufficient residence time to achieve high sulfone concentrations to avoid use of large volumes of methanol. Clean methanol is preferred to be the final wash before switching column 70 back to the adsorption cycle. It has been determined that about one bed volume of methanol will extract about 95% of the total sulfone adsorbed in the alumina. One or two additional bed volumes of methanol may be used to substantially desorb all the sulfones, although this is not necessary for the cyclical process with the regeneration procedure taught in the practice of this invention. Before switching to the adsorption cycle, the methanol is drained off the column, clean methanol is passed through to ensure removal of the trapped methanol extract. It is preferably allowed to flash through the column by reducing the back pressure, and then the remaining methanol wetting the solid bed is driven off by steam or hot gas stripping.

The column is now ready to be returned to the adsorption cycle without significant loss in its adsorption efficiency and without the need to reactivate it by high temperature treatment. Any amount of water chemically bound on the alumina as a result of the procedures in this invention do not have a negative effect on the adsorption/desorption cyclic operation. Chemically bound water on alumina would otherwise disqualify it as an activated alumina adsorber. The final treated fuel oil product exits in stream 74 to product tank 48 with typically residual sulfur levels of less than about 10 ppm, approaching zero. The actual low level of residual sulfur can be decided by preselecting the breakthrough point of columns 70 and 72 taking into account cost considerations. Fewer bed volumes of feed through columns 70 and 72 during the adsorption portion of the cycle will normally result in lower sulfur concentrations in the end product. The oxidation of sulfur compounds in the first reaction cause levels of less than about 15 ppm in the final product to be possible.

The sulfur-rich methanol extract in stream 78 is mixed into a hot gasoil in stream 80 and flashed in tower 82 to recover the methanol in the overhead stream 76 for recycle. The methanol transfers; the oxidized sulfur compounds, e.g., sulfones, into the gasoil at the bottom stream 84 for their further disposition such as, for example, into a coker. An alternate disposition method would be to transfer the oxidized sulfur compounds, e.g., sulfones, into a hydrotreater feed stream to be easily hydrogenated. Various methods for the disposition of sulfones have been described above and may be used here.

The process as described above may also be practiced outside of a refinery at a gasoline distribution center. The process, as described above, can be practiced through the separation of the hydrocarbon phase from the aqueous phase, which contains the oxidized sulfur compounds. The hydrocarbon phase is then placed into the distribution matrix. The aqueous phase has the oxidized compounds separated from the formic acid and water. The oxidized compounds can be sent off-site for disposal or treatment. The formic acid and water are recycled to the process. Sulfones would be transported to a refinery or a land-fill for disposal.

There are many modifications available on the above described process, particularly after the separation of the oxidation/extraction solution containing the extract oxidized sulfur compounds, usually in the form of sulfones, from the treated hydrocarbon fuel. This treated fuel may have a sulfur concentration after the oxidation-extraction step of this invention of from about 50 to about 200 ppm in oxidized sulfur compounds depending upon the sulfur species that are present in the original material The sulfur may be totally oxidized, but the resulting oxidized species may have a non-zero, variable solubility in the fuel and, therefore, not be totally extracted into the oxidizing solution. Substituted thiophenes, such as alkylated ($C_1$, $C_2$, $C_3$, $C_4$, etc.) dibenzothiophenes, when oxidized require more rigorous removal techniques than simpler compounds as described above such as the unsubstituted thiophenes. The alumina-methanol adsorption-desorption system of the invention described above is one advantageous preferred technique for removing the alkyl substituted sulfone oxidation products. The above-described process of this invention, when compared to the cost of a subsequent hydrogenation reaction in a hydrotreater to reduce the sulfur content, operates at relatively benign temperatures and pressures, and utilizes relatively inexpensive capital equipment. The process of this invention acts very effectively on the exact sulfur species, i.e., substituted, sterically hindered thiophenes, which are difficult to reduce by even severe hydrogenation conditions and are left in available commercial gasoline fuels at levels of a little less than the regulatory limit of 500 ppm. With the current prospect of regulations reducing the maximum sulfur content of fuels, such as gasoline, to 10 to 15 ppm or less, the practice of this invention is very beneficial, if not necessary. This is particularly so in view of the counterintuitive use of low levels of hydrogen peroxide and the surprising recognition that the presence of excess water prohibits the successful complete-oxidation of the sulfur with low levels of hydrogen peroxide, which is a prerequisite to achieving residual sulfur levels approaching zero.

The foregoing exciting results are further demonstrated by the following examples, which are offered for purposes of illustration of the practice of this invention and for the understanding; not for the limitation thereof

EXAMPLES

Unless otherwise stated, the following general experimental procedure applies to all of the examples. The feed is a sulfur-containing liquid hydrocarbon. Different feeds tested in these non-limiting examples were:

a. Synthenic Gasoline containing 600_ppm (i.e., mg/kg) total sulfur b. ASTM Fuel QCS-02 Gasoline containing 340 ppm total sulfur Each different batch of feed was analyzed by gas chromatography/mass spectrometry (GC/MS). The oxidized fuel products were analyzed by the same technique, and the results were reported relative to the feed compositions.

The oxidizer-extractor compositions in the preferred embodiment of this invention were prepared at room temperature by the procedure of adding: hydrogen peroxide to formic acid reagent (96% by wt. formic acid) in a beaker. The measured amount of 30 wt% hydrogen peroxide was added and mixed into the formic acid. Then, a measured amount of water, if applicable, was added and mixed in. The composition was ready for use within three to 10 minutes.

Example 1

A synthetic gasoline stock solution was prepared to serve as a model and to evaluate the oxidation of contained sulfur and the effect, if any, on olefinic compounds. The synthetic gasoline included representative saturate, aromatic, olefinic, and sulfur containing hydrocarbons in a distribution that is consistent with current commercial gasolines. The sulfur compounds of the synthetic gasoline were thiophene, tetrahydrothiophene, and dibutylsulfide, which are distributed widely over the boiling range of gasoline. These sulfur compounds contributed 258, 227 and 115 ppm of sulfur respectively, in the synthetic gasoline as determined by gas chromatography/mass spectrometry analysis. The sulfur compounds represent targeted sulfur classes in gasoline (thiophenes, sulfides, and cyclic sulfides). The synthetic gasoline also included olefins and aromatic components, which are also, susceptible to oxidation. The olefinic content was about 12.1% by volume. The stock solution was kept refrigerated. A sample of the gasoline stock solution was and from hereon analyzed by GC/MS.

Example 2

A test was done to determine the effect that excessive oxidizing conditions would have on the olefinic compounds as sulfur compounds are oxidized to their respective sulfones and sulfoxides. The excessive conditions consisted of an excess of hydrogen peroxide and a reaction temperature of 90° C.

Seventy five (75 ml) of the refrigerated synthetic gasoline as described above was added in a 250 ml stirred autoclave which had also been previously stored in the freezer. The air was displaced with argon, and the autoclave sealed at an argon pressure slightly above atmospheric. The autoclave was then heated to a constant 88–90° C. while stirring. The total pressure at 88° C., before addition of the oxidant solution, was about 20 psig.

The aqueous oxidizing solution was prepared by mixing 0.91 ml hydrogen peroxide 30 wt % solution into 7.0 ml formic acid 96 wt % reagent, and then adding 0.5 ml water. The amount of hydrogen peroxide was 4 times the stoichiometric requirement for oxidizing the sulfur present and a concentration of 3 wt % hydrogen peroxide in the aqueous oxidizer mixture. The oxidant solution was ready to use within a few minutes. The oxidant solution was added by means of an addition cylinder pressurized with nitrogen, when the temperature was stabilized.

After one hour of stirring at 90° C., the autoclave was quenched to ambient temperature and then refrigerated for 30 minutes before opening. A two phase product consisting of an oil phase and an aqueous phase was obtained. A sample of the oil phase was filtered by means of a syringe with a filtering element, A small amount of calcium oxide was added to the filtered oil phase to neutralize any residual formic acid, and to dry the sample.

The oil phase product was analyzed by gas chromatography/mass spectrometry. Overall approximately 88% of the sulfur was oxidized. All of the tetrahydrothiophene and the dibutyl sulfide were completely reacted. However, 70 PPM of the thiophene, approximately 30% of the original amount, remained unreacted. The lower reactivity of the thiophene is believed to be a result of limitations in the laboratory experiment. while not wishing to be bound by them, thiophene, relative to the other components in the synthetic mixture, has a low boiling point (84° C.). The reaction temperature was 90° C. Therefore a high proportion of the thiophene was in the vapor phase and had limited contact with the oxidant. A small amount of alcohols, aldehydes and ketones were also formed. These oxygenates collectively totaled approximately 1000 PPM. These oxygenates all contain eight carbon atoms and therefore must have been derived from 2,4,4-trimethyl-2-pentene. This olefin is highly branched and is more susceptible to oxidation than other less branched olefins. It also has a relatively high boiling point and therefore was in good contact with the oxidant. Most of the excess oxidant was converted into oxygenates. The toluene contains benzylic hydrogen atoms and is also potentially susceptible to oxidation, but it remained unreacted.

Example 3

A test was done to determine the effect that mild oxidizing conditions would have on the olefinic compounds as sulfur compounds are oxidized to their respective sulfones and sulfoxides. The mild conditions consisted of a lower excess of hydrogen peroxide and a reaction temperature of 70° C.

A test was carried out as was Example 2 above, but under milder oxidizing condition, which included a lower stoichiometric excess of hydrogen peroxide, i.e. 2.5 StF. The aqueous oxidizer solution composition was 0.57 ml hydrogen peroxide 30 wt %, 8.75 ml formic acid 96 wt%, and 1.26 ml water corresponding to a lower concentration of hydrogen peroxide, 1.5 wt %. The reaction temperature was 69–70° C., instead of 90° C. The total pressure at 69° C., before addition of the oxidant, was about 14 psig. After addition of the oxidant under nitrogen pressure, the total pressure in the autoclave was 69 psig. The temperature was maintained constant for one hour at 69–70° C.

Overall, approximately 75% of the sulfur was oxidized under these milder conditions. The oil phase sample was obtained, handled, and analyzed as in Example 2. Again, all of the tetrahydrothiophene and the dibutyl sulfide were completely reacted, but less of the thiophene was converted. About 150 PPM of the thiophene, approximately 60% of the original amount, remained unreacted. Again, not being bound by them, the thiophene was still probably in poor contact with the oxidant. Only 300 ppm of oxygenates were generated. Again, the oxygenate content generally represents the amount of excess oxident which was added to the reactor.

Example 4

A test was carried out with a standard conventional gasoline sample, ASTM-Fuel-QCS-02, obtained from AccuStandard Corp., to determine the effect that mild oxidizing conditions would have on the olefinic compounds as sulfur compounds are oxidized to their respective sulfones and sulfoxides following the general experimental procedure described in Examples 2 and 3 above. The mild conditions consisted of a lower excess of hydrogen peroxide and a reaction temperature of 65° C.

A 45 ml. gasoline sample was introduced into the 250 ml autoclave. The operating temperature during the test was kept constant at 62–65° C. The aqueous oxidizer solution consisted of 4.46 ml formic acid (96 wt %), 0.30 ml hydrogen peroxide (30 wt %), and 0.64 ml water, corresponding to a lower concentration of hydrogen peroxide, i.e. 1.5 wt %. The total pressure in the reactor was 45 psig, with most of it due to the nitrogen used to introduce the oxidizer solution through the addition cylinder.

The standard ASTM gasoline and the oxidized gasoline were analyzed using Flame Ionization Sulfur Chemiluminescence Gas Chromatography, X-ray reflectance Spectroscopy (ASTM Method D-2622), and Gas Chromatography/Mass Spectrometry. The amount of sulfur (by D-2622 method) in the standard ASTM gasoline was 336 mg/kg (ppm) and the amount of total olefins was 12.38 volume % (by ASTM Method D-1319 Standard Test Method for Hydrocarbon Types in Liquid Petroleum Products by Fluorescent Indicator Adsorption).

At the end of reaction, about one hour, and after cooling, a sample of the oxidized gasoline was filtered (0.45 micron) using a syringe with a filtering element, and with addition of a small amount of calcium oxide to neutralize any of the acid and remove water. Part of this sample was analyzed by GC/MS for total sulfur. The remainder, was filtered again, this time over alumina to extract the oxidized sulfur compounds in the gasoline matrix, and submitted for ASTM D-2622 analysis.

The overall sulfur content was lowered from 336 PPM to 237 PPM (about a 30% reduction). The higher boiling gasoline components, which include alkylated thiophenes and some benzothiophenes, were efficiently oxidized and removed. The lower boiling sulfur components were essentially non-reactive. Again, it is probable that poor contact with the oxidant is the problem. The overall composition of the ASTM gasoline remained unchanged.

In summary, more volatile sulfur hydrocarbons should be reacted at somewhat higher pressures with more efficient mixing to insure proper contact with the oxidant. The sulfur compounds react faster than the olefinic compounds and much faster than benzylic compounds. Shorter react times and better mixing would result in sulfur conversion. The extent of oxygenate formation can be directly controlled by the amount of oxidant added.

The foregoing description of the invention and the specific examples described demonstrate the surprising nature of the oxidizing/extracting solution and the process for desulfurizing hydrocarbon fuels, especially those having low levels of sulfur present. The above-described description is offered for purposes of disclosing the advantages of the instant invention for use in desulfurizing the aforementioned fuel oils. Having been taught such process by the above discussion and examples, one of ordinary skill in the art could make modifications and adaptations to such process without departing from the scope of the claims appended hereto. Accordingly, such modification, variations and adaptations of the above-described process and compositions are to be construed within the scope of the claims which follow.

What is claimed is:

1. A process for removing sulfur compounds from a gasoline fuel without substantially reducing the octane rating of the hydrocarbon fuels, comprising the steps of:

contacting the sulfur containing fuel with an aqueous oxidizing solution comprising hydrogen peroxide, and formic acid in a mole ratio of at least about 11:1 formic acid to hydrogen peroxide and having less than about 25 wt % water, in an amount such that the hydrogen peroxide present is greater than about two times the stoichiometric amount required to convert the sulfur compounds present to corresponding sulfones, at a temperature of from about 50° C. to about 130° C. to form a hydrocarbon fuel phase from which sulfur has been removed and an aqueous phase containing oxidized sulfur extracted from the hydrocarbon fuel phase;

separating the aqueous phase from the hydrocarbon fuel phase; and recovering the hydrocarbon phase containing the fuel having reduced sulfur content substantially without reducing the octane rating of the fuel.

2. The process of claim 1, wherein the gasoline fuel further comprises alkenes and the process further comprises converting less than 1% of said alkenes to alcohols by contacting the alkene containing fuel with the aqueous oxidizing solution with the converted alcohols remaining in the hydrocarbon phase.

3. The process of claim 1 wherein the mole ratio of formic acid to hydrogen peroxide is from about 20:1 to about 60.

4. The process of claim 1 also including the steps of:

distilling the aqueous phase to remove water from the acid; and recovering the acid.

5. The process of claim 4 also including the step of recycling the recovered acid as part of the acid to use in the aqueous oxidizer solution.

6. The process of claim 1 wherein the formic acid is present in the oxidizing solution in an amount of from about 75 wt % to about 92 wt %, and the hydrogen peroxide is present in an amount of from about 0.5% to about 4 wt %.

7. The process of claim 1 wherein the oxidation step occurs in less than about 15 minutes contact time.

8. The process of claim 1 wherein the amount of the oxidizing solution added is sufficient to provide a stoichiometric excess of from about 2 to about 4 times the amount required to oxidize the sulfur present.

9. The process of claim 7 wherein the stoichiometric excess is from about 3.0 to about 3.3 times the amount required to oxidize the sulfur present in the gasoline fuel.

10. The process of claim 1 including the further step of:

treating the recovered hydrocarbon phase with a sufficient quantity of calcium oxide to neutralize any residual acid therein;

and separating the neutralized fuel from the calcium oxide.

11. A process for removing sulfur compounds from gasoline fuel comprising the steps of:

contacting the gasoline fuel at a temperature of from about 90° C. to about 105° C. for a period of time up to about 15 minutes with an oxidizing solution comprising:

from about 79 wt % to about 89 wt % formic acid, from about 2 wt % to about 3 wt % hydrogen peroxide, and from about 8 wt % to about 14 wt % water;

in an amount such that the molar ratio of formic acid to hydrogen peroxide is from about 20:1 to about 60: 1, wherein the amount of oxidizing solution added is such that there is a stoichiometric excess of hydrogen peroxide necessary to oxidize the sulfur present in the gasoline fuel in an amount of from about 2.5 to about 3.5 times the amount needed to oxidize the sulfur in the fuel;

extracting, during the oxidizing step, the oxidized sulfur compounds from the gasoline fuel into the aqueous oxidizing solution to form a hydrocarbon phase and an aqueous phase;

separating the aqueous phase containing the extracted sulfur compounds from the hydrocarbon fuel phase;

neutralizing any residual acid in the fuel;

recovering the neutralized gasoline fuel containing less than about 25 ppm sulfur.

12. The process of claim 11 wherein the gasoline contains up to about 500 ppm sulfur by weight.

13. The process of claim 11 wherein the gasoline is a CARB or RFG fuel.

14. A process for removing sulfur compounds from a gasoline hydrocarbon fuel containing thiophenes, benzothiophenes, and alkyl-substituted thiophenes, and benzothiophenes without affecting the octane rating of the hydrocarbon fuel comprising the steps of:

contacting, at a temperature of from about 65° C. to about 110° C., the sulfur-containing fuel with an aqueous oxidizing solution comprising hydrogen peroxide and formic acid in a mole ratio of at least about 11:1, formic acid to hydrogen peroxide, and having a content of from about 8 wt % to about 20 wt % water, in an amount such that the hydrogen peroxide present in greater than about 2 times the stoichiometric amount required to convert the sulfur compounds present to corresponding sulfones whereby a hydrocarbon fuel phase is formed which contains oxidized alkyl-substituted benzothiophenes, as sulfones, and an aqueous phase containing substantially all the oxidized benzothiophenes in the form of the corresponding sulfones;

separating the aqueous phase containing the extracted, oxidized benzothiophene sulfur compounds from the hydrocarbon phase containing oxidized alkyl- substituted benzothiophenes in the form of the corresponding sulfones;

neutralizing and dewatering the hydrocarbon phase;

passing the hydrocarbon phase through a bed of an alumina adsorbent to adsorb the oxidized alkyl-substituted benzothiophenes and dibenzothiophenes from the fuel; and recovering the fuel having substantially lowered sulfur content from the oxidized sulfur compounds.

15. The process of claim 14 wherein the drying and neutralization is accomplished by adding calcium oxide to the hydrocarbon phase fuel; and filtering the fuel to remove the solids from the fuel.

16. The process of claim 14 including the additional steps of:

cooling the hydrocarbon phase between the flashing step and the neutralizing and dewatering step; and adding the calcium oxide to the hydrocarbon stream prior to introduction into a post-treatment vessel serving as a solids liquids separator.

17. The process of claim 14 including the additional steps of adding gasoil to the separated aqueous phase to separate the water and formic acid from the gasoil and oxidized benzothiophene sulfur compounds:

flashing the aqueous phase containing the extracted, oxidized benzothiophene sulfur compounds to separate the formic acid and water from any residual oxidized sulfur compounds as an overhead stream;

distilling the overhead stream to remove water from the formic acid;

recycling the formic acid for reuse in the oxidizing solution; and disposing of the gasoil and oxidized benzothiophene sulfur compounds.

18. The process of claim 17 wherein disposing of the gasoil and oxidized benzothiophene sulfur compounds comprises sending the gasoil and oxidized benzothiophene sulfur compounds to a hydrotreater or a coker.

* * * * *